US011612220B2

(12) United States Patent
Moritz

(10) Patent No.: US 11,612,220 B2
(45) Date of Patent: Mar. 28, 2023

(54) BELT COMPRISING A BUCKLE AND STRAP

(71) Applicant: Randi Hollyn Moritz, Virginia Beach, VA (US)

(72) Inventor: Randi Hollyn Moritz, Virginia Beach, VA (US)

( * ) Notice: Subject to any disclaimer, the term of this patent is extended or adjusted under 35 U.S.C. 154(b) by 0 days.

(21) Appl. No.: 14/447,610

(22) Filed: Jul. 30, 2014

(65) Prior Publication Data

US 2015/0033518 A1 Feb. 5, 2015

Related U.S. Application Data

(60) Provisional application No. 61/860,406, filed on Jul. 31, 2013.

(51) Int. Cl.

| | |
|---|---|
| ***A44B 11/22*** | (2006.01) |
| ***A44C 5/18*** | (2006.01) |
| ***A41F 9/00*** | (2006.01) |

(52) U.S. Cl.

CPC ..... *A44B 11/22* (2013.01); *A41F 9/002* (2013.01); *A44C 5/18* (2013.01); *Y10T 24/2192* (2015.01); *Y10T 24/4088* (2015.01)

(58) Field of Classification Search

CPC ... A41F 9/02; A41F 9/00; A41F 9/002; A44B 11/22

USPC ..... 24/68 E, 198

See application file for complete search history.

(56) References Cited

U.S. PATENT DOCUMENTS 154,673 A * 9/1874 Higinbotom et al. ..... 24/176
598,320 A * 2/1898 Knapp ..... A41B 3/08 24/198
912,053 A * 2/1909 Alcorn ..... A44B 11/04 24/198
1,316,611 A * 9/1919 Hartman ..... A44B 11/04 24/198
1,682,450 A * 8/1928 Wanninger et al. ..... 24/323
2,049,414 A * 8/1936 Cohen ..... 2/322
2,641,812 A * 6/1953 Boudreau ..... A44B 11/20 24/176
2,783,516 A * 3/1957 Stein ..... A44B 11/22 24/176
3,913,147 A * 10/1975 Ostrander ..... 2/325
4,477,949 A * 10/1984 Calabro ..... 24/180
6,412,148 B1 * 7/2002 Morris ..... 24/176
(Continued)

FOREIGN PATENT DOCUMENTS

WO WO2012049626 * 4/2012

*Primary Examiner* — Alissa L Hoey
*Assistant Examiner* — Patrick J. Lynch
(74) *Attorney, Agent, or Firm* — Stein IP, LLC

(57) ABSTRACT

A belt comprises a strap (10) extending between a first end portion (10*a*) and a second end portion (10*b*) along a respective principal direction of extension and comprising a plurality of through locking holes (11) arranged one after another and at least one through fastening opening (15). The belt also comprises a buckle (2), which can be removably coupled with the strap (10), comprising a main body (3) and at least one tongue (4) connected to an outer face (3*a*) of the main body (3) and projecting from it to form a free end (4*b*) which can engage in at least one of the through locking holes (11) in the strap (10) The buckle (2) also comprises a fastening element (5) protruding from the outer face (3*a*) of the main body (3) and configured for removably coupling the buckle (2) and the strap (10).

4 Claims, 4 Drawing Sheets

(56) References Cited

U.S. PATENT DOCUMENTS

| | | | | |
|---|---|---|---|---|
| 8,429,798 | B1 * | 4/2013 | Paigen | A44B 11/22<br>224/150 |
| 2013/0283501 | A1 * | 10/2013 | Moritz | 2/321 |

* cited by examiner

BELT COMPRISING A BUCKLE AND STRAP

RELATED APPLICATIONS

This application claims the benefit of provisional application Ser. No. 61/860,406 filed Jul. 31, 2013, the entirety of which is incorporated herein by this reference.

This application is also related to application Ser. No. 13/991,519, a National Phase of PCT IB2011/054483 filed Oct. 11, 2011 claiming priority from Italian application B02010A00608 filed Oct. 11, 2010. The subject matter of application Ser. No. 13/991,519 is incorporated herein by this reference. Application Ser. No. 13/991,519 was published as Patent Publication 2015/0033518 on Feb. 5, 2015.

TECHNICAL FIELD

This invention relates to a belt which comprises a buckle coupled with a strap to form the belt. The invention applies in particular to the field of fashion and apparel, especially to the accessories market.

It should be noted that the term "belt" is not used to apply only to accessories worn around the waist but more generally to any accessory having a buckle and a strap which can be coupled with each other, be it a bracelet, a necklace or the like.

DISCLOSURE OF THE INVENTION

An aim of this invention is to provide a belt comprising a buckle coupled with a strap to form the belt where fastening and unfastening the buckle and strap are simple but the fastening between the belt and buckle is more secure than in many other belts. It is another aim of the invention is to provide a belt that is easy to unfasten.

A further aim of the invention is to provide a buckle that makes its fastening to the strap particularly secure.

A still further aim of the invention is to provide a belt wherein substitution of one strap for another is simple without comprising the security of the fastening between one strap or the other and the buckle.

These aims are fully achieved by the belt according to the invention as characterized in the appended claims and, more specifically, in that the buckle comprises a fastening element with a portion of maximum width having a predetermined shape and substantially sized to match a fastening opening in the strap. The buckle further comprises a tongue which engages a through locking hole in the strap.

The aims are also fully achieved by the buckle according to the inventions as characterized in the appended claims and, more specifically, in that the fastening element has a portion of maximum width with a predetermined shape and in that the projection of the portion of maximum width on the outer face of the central body subtends an area which is larger, preferably at least five times larger, than the area subtended by the projection of the free end of the tongue on the outer face.

The aims are also achieved by the strap according to the invention as characterized in the appended claims and, more specifically, in that the fastening opening defines a gap which is greater in area than the gap defined by a through locking hole.

BRIEF DESCRIPTION OF THE DRAWINGS

This and other features are described in more detail below with reference to a preferred, non-limiting example embodiment, with refer to the accompanying drawings, in which.

DESCRIPTION OF PREFERRED EMBODIMENTS

Figure 1:
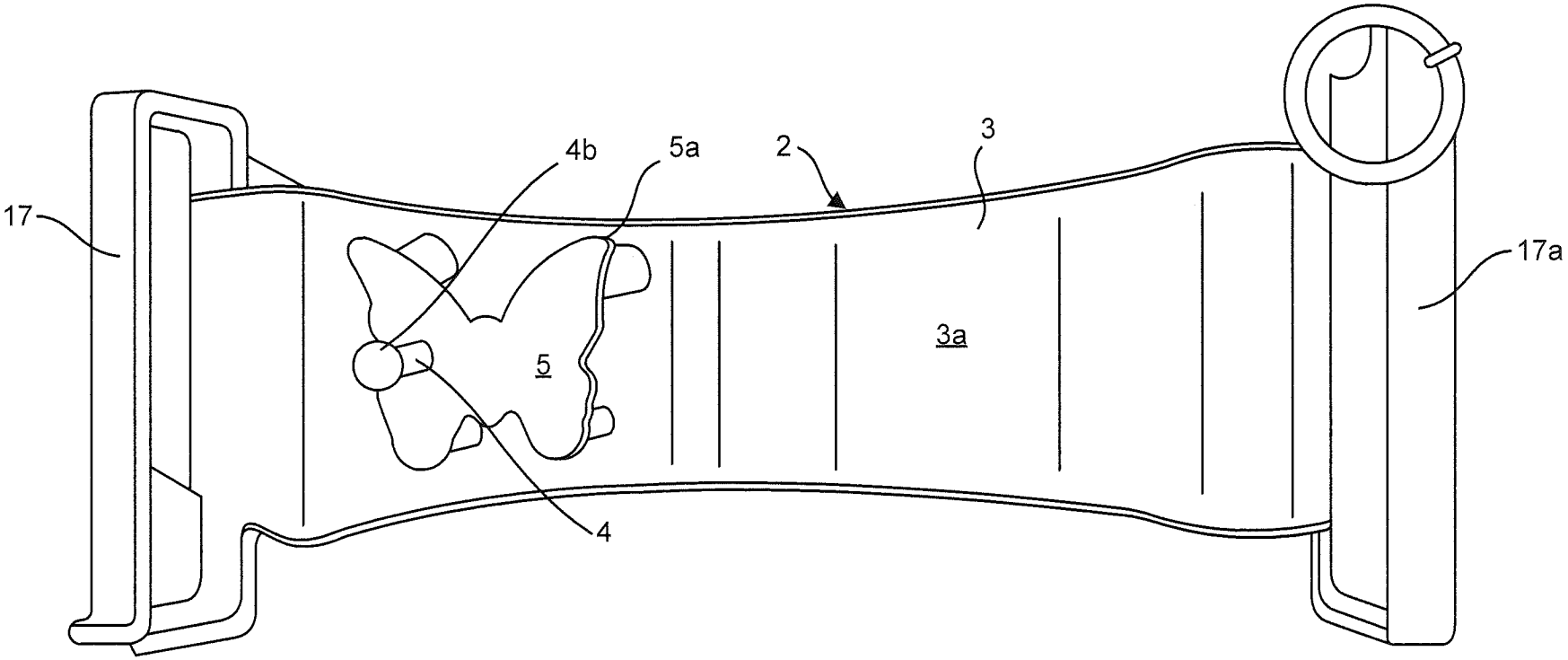
FIG. 1 shows a schematic perspective view of a buckle according to this invention.
Figure 2:
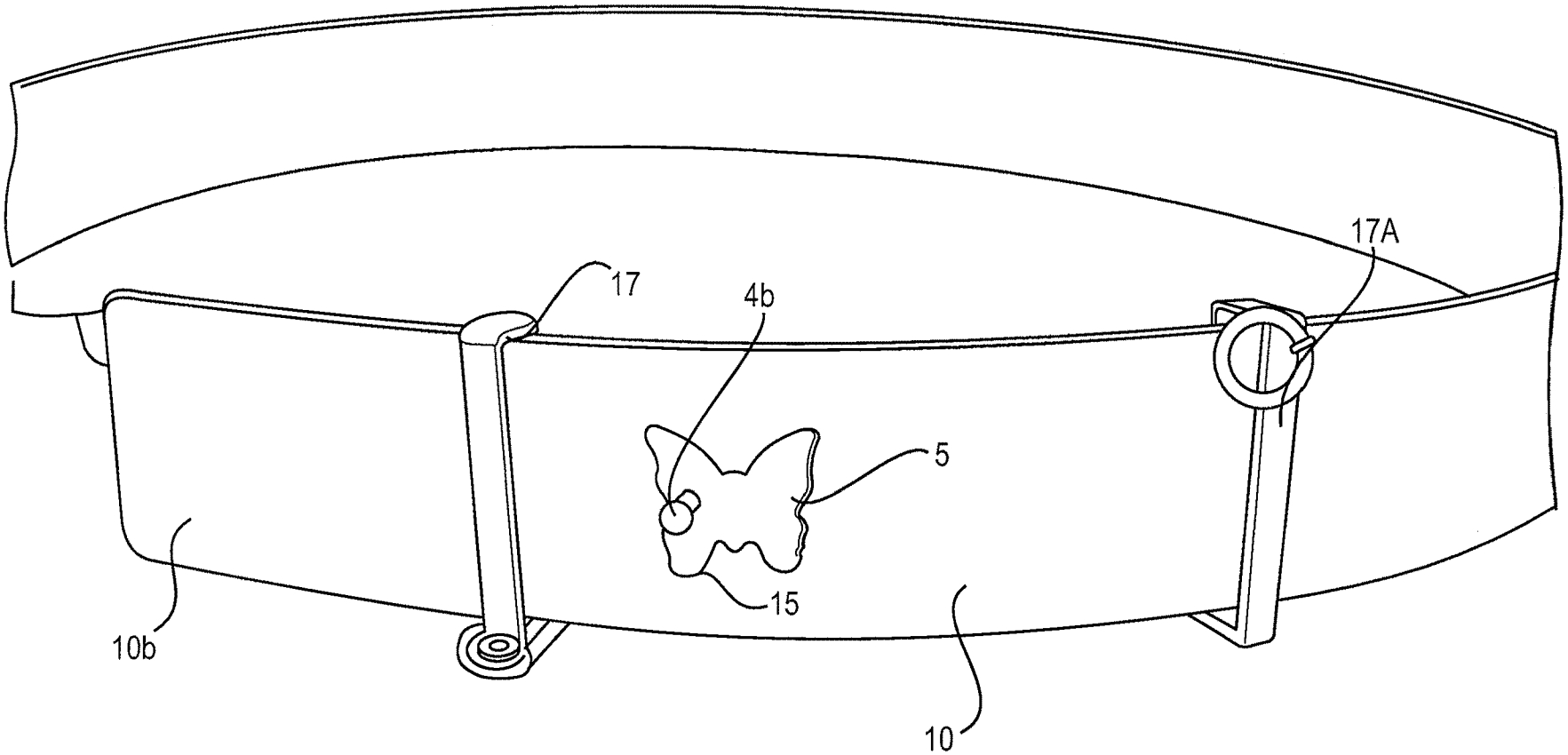
FIG. 2 shows a belt and buckle according to the invention, with the strap partially engaged with the buckle.
Figure 3:
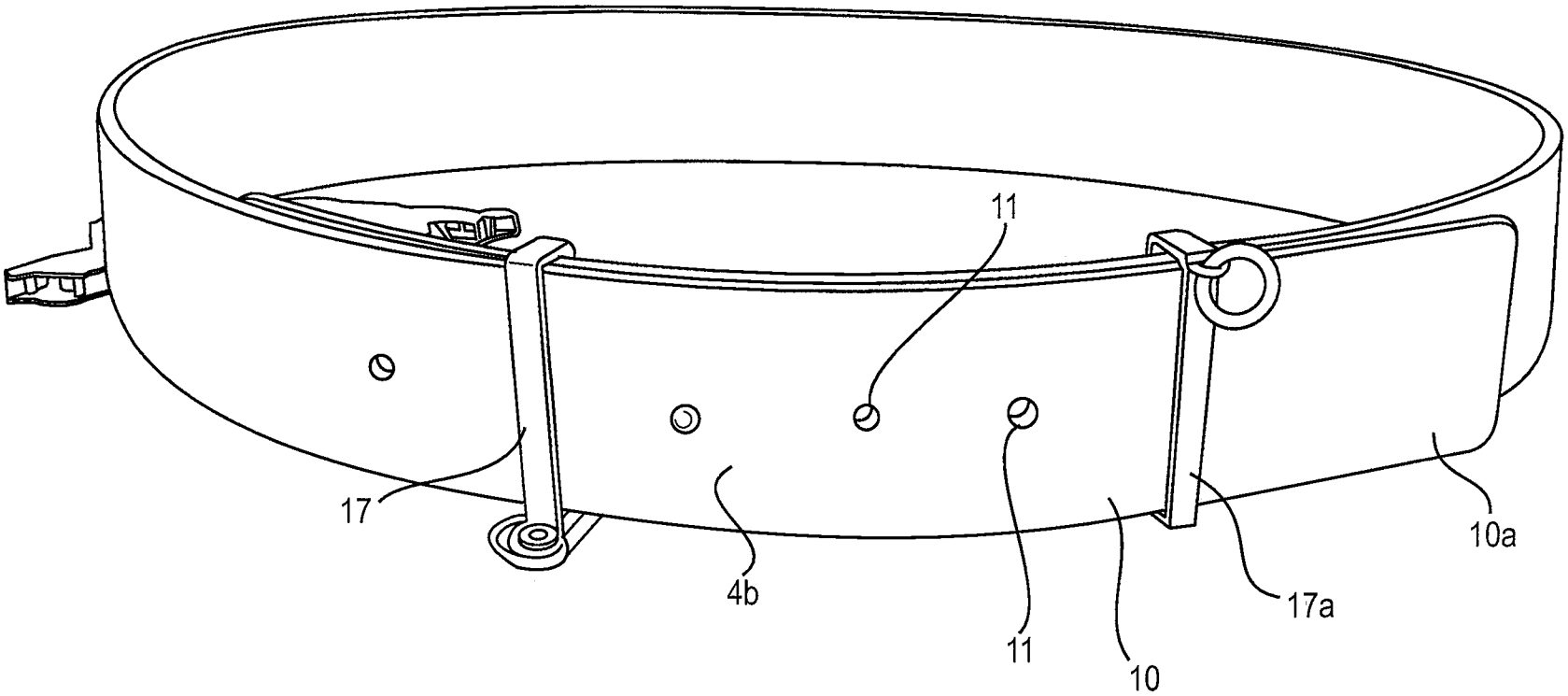
FIG. 3 shows the belt and buckle according to the invention where the strap is fully engaged with the buckle.

FIGS. 1, 2 and 3 of this application illustrate an embodiment of my invention including a belt comprising a buckle 2 and strap 10 in which the buckle 2 has many components in common with the buckle illustrated in application Ser. No. 13/991,519. Some of those common elements include buckle 2 with a fastening element 5 and tongue 4. It is an advantage of the invention that many different buckles can be used with a single strap by removing one buckle from a strap and inserting another. When the strap 10, associated with the buckle described in this application, is placed around the waist of a user the fastening element 5 and tongue 4 of the buckle 2 are supported on that side of the buckle which, in use, faces away from the user's body, i.e., the outer face of the buckle 2. The belt illustrated in this application may also be used in applications other than around the waist of a user, such as a bracelet or necklace for example.

The buckle 2 and strap 10 illustrated in this application may have at least some of the same components as those of the buckle and strap illustrated in application Ser. No. 13/991,519, although some of the buckle components have a different relation to the buckle than those illustrated in the application. Both the buckle illustrated in application Ser. No. 13/991,519 and the buckle 2 of this application have a curved form with convex and concave faces.

As seen in FIG. 1 the buckle 2 includes an outer convex face 3*a*, a fastening element 5 and a tongue 4 with a free end 4*b*. The fastening element 5 is directly supported by the face 3*a* (the fastening element 5 rises up from the face 3*a*) and the tongue 4 is supported directly by the fastening element 5 and indirectly by the face 3*a*. The designation of the face 3*a* of the buckle 2 as an outer face, in this application means that if the belt is placed around a body portion of a user, the outer face 3*a* faces away from the user's body. The buckle 2 also includes guides 17 and 17*a* (which may or not be visible when the buckle is in use) spaced at opposite extremities of the buckle 2 for guiding the strap 10.

FIG. 2 illustrates the belt in a condition in which application of the belt to the waist (for example) of a user is partly accomplished. More particularly, as illustrated in FIG. 2 the strap 10 has been threaded through the guides 17 and 17*a* of the buckle 2, the fastening opening 15. In the strap 10 is engaged with the fastening element 5 of the buckle 2. The other end 10*a* (not shown in FIG. 2) of the strap is not yet threaded through the guides 17 and 17*a*, nor has the free end 4*b* of the tongue 4 been inserted through an appropriate locking hole 11 of the strap 10.

FIG. 3 shows the end 10*a* of the strap 10 has now been threaded through the guides 17 and 17*a* and the free end 4*b* of the tongue 4 is now engaged with an appropriate one of the locking holes 11. Application of the belt to the body of a user as illustrated in FIG. 3 is complete.

Preferably, the strap 10 is made of leather or other animal skin. Alternatively, the strap may be made of cord or like material. In other words, it is particularly important, for reasons that will become clearer as this description continues, that the strap 10 be made of a material which is deformable.

In the embodiment illustrated, the strap has a substantial constant thickness "S" throughout its full length. Alternatively, different parts of the strap might differ in thickness. The strap 10 further comprises at least one through locking hole 11 located preferably in the proximity of the first end portion 10*a* of the strap. More preferably, the strap 10 comprises a plurality of through locking holes 11 located, preferably in line, one after the other. The through locking holes 11 are located in the proximity of the first end portion 10*a* and extend away from it. Each of the holes 11 defines a gap that runs through the strap 10. In use, the through locking holes 11, as it known, allow the belt 1 to be adjusted according to the wearer's size or the position where he/she wishes to wear it, by engaging with a corresponding tongue 4 forming part of the buckle 1.

Further, the strap 10 has a through fastening opening 15 located in the proximity of the second end portion 10*b*. The opening 15 is adapted to engage with a respective fastening element 5 forming part of the buckle 2 and has a predetermined shape and is sized to match at least part of the fastening element 5. Further, the opening 15 is defined at its perimeter by an edge or inside wall having a series of projections and recesses. Still more preferably, the inside wall has an irregular shape. In other words, the inside wall is substantially uneven. Preferably, the opening 15 defines a gap which is larger in area than the gaps 11*a* defined by the through locking holes 11.

In effect, the matching shape of the opening 15 and the portion of maximum width 5*a* means that the user can easily detach the second end portion of the strap 10 from the buckle 2 by applying a force transversal to the opening 15 and the portion of maximum width 5*a*.

On the other hand, any tangential action, however slight, that is to say, any action that has a component in a direction parallel to the plane of the opening 15 or of the portion of maximum width 5*a* causes the inner wall 15*a* of the opening to be deformed on account of pressure against the step 16, thereby preventing the strap 10 and the buckle 2 from being unfastened.

Considering, moreover, that such tangential actions are typical of the belt 1 when it is being worn, accidental unfastening of the second end portion 10*b* of the strap 10 from the buckle 2 is easily prevented.

In a first embodiment, the connecting portion 5*b* is defined by a plurality of feet which connect the portion of maximum width 5*a* and the main body 3.

Alternatively, the connecting portion may be a single block interposed between the portion of maximum width 5*a* and the main body 3.

Preferably, also, the distance between the portion of maximum width 5*a* and the main body 3, more specifically, outer face 3*a*, is less than or equal to the aforementioned thickness "S" of the strap 10, at least in the proximity of the opening 15.

Advantageously, this prevents loose fitting between the portion of maximum width 5*a* and the opening 15 and, more specifically, prevents the opening 15 and the portion of maximum width 5*a* from going out of alignment, thus preventing their unfastening.

In other words, there can thus be no relative movement between the strap and the main body 3.

Preferably, the radial extension of the free end 4*b* of the tongue 4 defines a smaller area than the portion of maximum width.

In other words, the projection of the portion of maximum width 5*a* on the outer face 3*a* of the central body 3 subtends an area which is greater than the area subtended by the projection of the free end 4*b*.

In the preferred embodiment, the projection of the portion of maximum width 5*a* on the outer face 3*a* of the central body subtends an area which is at least five times greater than the area subtended by the projection of the free end 4*b*, on the outer face 3*a*.

Preferably, the tongue and the fastening element 5 are rigidly connected and superposed.

More specifically, the tongue 4 is superposed over the fastening element 5.

Thus, the first end 4*a* of the tongue 4 is rigidly connected to the fastening element 5.

In the embodiment illustrated, the tongue 4 protrudes from the portion of maximum width of the fastening element 5.

Preferably, the distance between the free end 4*b* of the tongue 4 and the outer face 3*a* of the main body 3 substantially corresponds to twice the thickness "S" of the strap 10.

More specifically, the distance between the free end 4*b* of the tongue 4 and a top face 5*d* of the portion of maximum width 5*a* of the fastening element is approximately half the distance between the selfsame free end 4*b* and the outer face 3*a* of the main body 3.

Advantageously, that way, when the belt 1 is in the closed configuration, the first end portion 10*a* of the strap 10 contributes to keeping the second end portion of the strap 10 coupled with the portion of maximum width 5*a* of the fastening element.

The buckle 2 also comprises a ring 17 protruding from the outer face 3*a* of the main body 3.

Preferably, the ring 17 and the fastening element 5 are located on opposite sides of the outer face 3*a* of the main body 3.

The ring 17 defines an aperture 18 for the passage of the strap.

In other words, the ring 17 acts as a loop for the strap 10 and helps keep the strap in the correct position for use.

Preferably, the distance between a crosspiece of the loop 17 and the main body 3, in particular the outer face 3*a* thereof, is greater than twice the thickness "S" of the strap 10.

Figure 4:
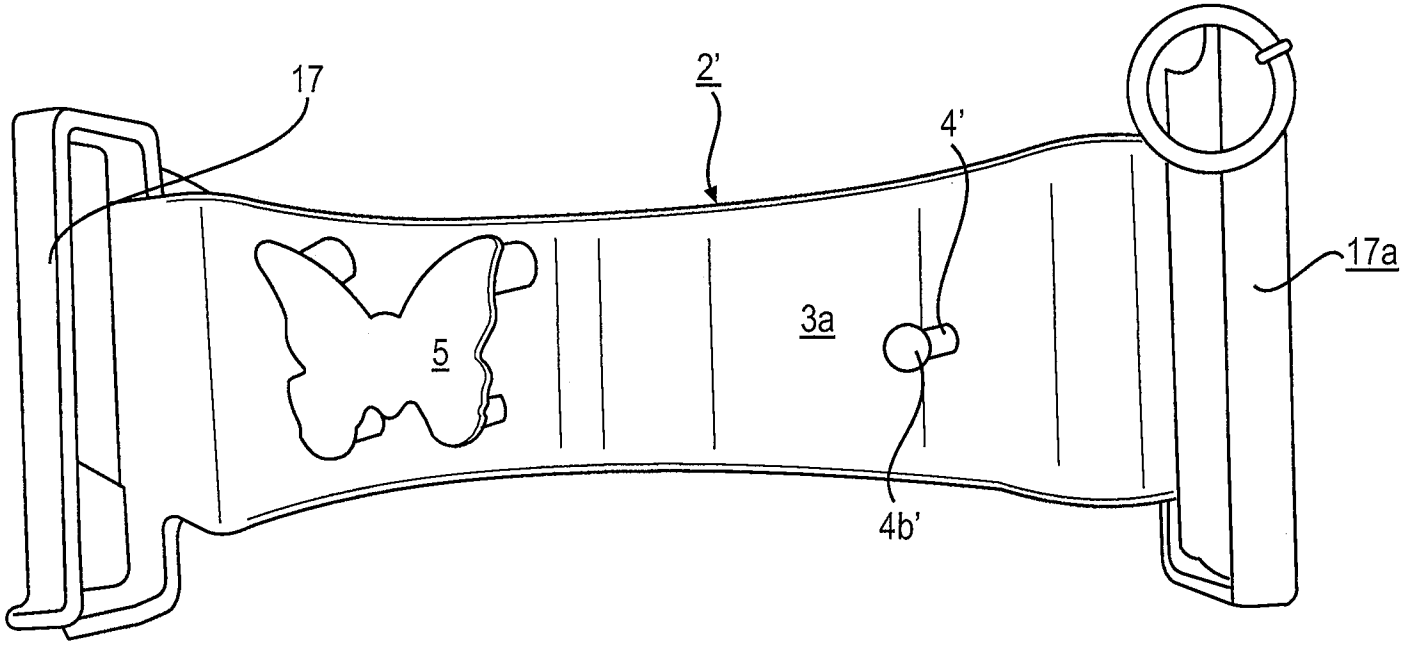
FIG. 4 shows a schematic perspective view of a buckle which differs from the buckle illustrated in FIG. 1.

FIGS. 1-3 of this application illustrate a buckle 2 with a fastening element 5 and a tongue 4, where the tongue 4 is supported within the area occupied by the fastening element 5. While this is a convenient arrangement it is not the only embodiment of the invention. FIG. 4 shows another buckle 2' where the tongue 4' is located on the outer face of the buckle 2' outside of the area occupied by the fastening element 5. In this embodiment the tongue 4' can be located anywhere on the outer face 3*a* of buckle 2' outside of the fastening element 5, i.e., spaced from the fastening element 5, not spaced from the fastening element 5, above or below the fastening element 5, etc.

The invention claimed is:

1. A buckle which can be coupled with a strap to form a belt, configured to be worn by a user, the buckle comprising:

a main body, at least one tongue supported by and extending from a first face of the main body and projecting from it the first face to form a free end which can engage in at least one through hole in the strap;

a fastening element directly supported by, extending from and rising up from the first face of the main body and designed for removably coupling the buckle with the strap; characterized in that the fastening element comprises a portion of maximum width having a predetermined shape, a projection of the portion of maximum width on the outer first face of the main body subtending an area which is at least three times greater than the area subtended by a projection of the free end of the at least one tongue on the first face; and a pair of guide means supported by the main body and spaced from each other for positioning the strap.

2. The buckle according to claim 1, wherein the portion of maximum width of the fastening element is defined at its perimeter by an edge which is irregular, comprising a series of projection and recesses.

3. The buckle of claim 1 in which the main body has a curved form and the first face is convex.

4. The buckle according to claim 3, wherein the portion of maximum width of the fastening element is defined as its perimeter by an edge which is irregular, comprising a series of projection and recess.

* * * * *